US007347580B2

(12) United States Patent
Blackman et al.

(10) Patent No.: US 7,347,580 B2
(45) Date of Patent: Mar. 25, 2008

(54) ADAPTER DEVICE FOR MOUNTING A CEILING ELECTRICAL LIGHT FIXTURE

(75) Inventors: Stephen Blackman, Buffalo Grove, IL (US); Gary Stabelfeldt, West Allis, WI (US)

(73) Assignee: American Fluorescent Corporation, Waukegan, IL (US)

( * ) Notice: Subject to any disclaimer, the term of this patent is extended or adjusted under 35 U.S.C. 154(b) by 112 days.

(21) Appl. No.: 11/030,756

(22) Filed: Jan. 7, 2005

(65) Prior Publication Data

US 2006/0152920 A1 Jul. 13, 2006

(51) Int. Cl.
*F21S 8/06* (2006.01)

(52) U.S. Cl. ..... 362/147; 362/406; 362/457

(58) Field of Classification Search ..... 362/147, 362/148, 150, 217, 404, 457, 458, 406; 174/50, 174/54, 58, 61, 63; 248/343, 906, 342, 344, 248/345; 220/3.4, 3.94, 3.7, 3.5
See application file for complete search history.

(56) References Cited

U.S. PATENT DOCUMENTS 1,600,659 A * 9/1926 Williamson ..... 248/343
2,433,819 A 12/1947 Scribner
2,971,670 A * 2/1961 McCormack ..... 362/374
3,601,276 A * 8/1971 Culpepper ..... 220/3.4
4,199,803 A * 4/1980 Hunt, III ..... 362/263
4,222,093 A * 9/1980 Garcia et al. ..... 362/147
4,368,506 A 1/1983 Rapp
4,754,947 A * 7/1988 Propp ..... 248/544
6,131,863 A * 10/2000 Fiacco ..... 248/200
2003/0082948 A1* 5/2003 Hakkarainen et al. ..... 439/531

* cited by examiner

*Primary Examiner*—Sharon E. Payne
(74) *Attorney, Agent, or Firm*—Gerald M. Newman

(57) ABSTRACT

An adapter device, for enabling installation of an electrical light fixture to a ceiling mounted electrical box by one person, includes an opening into which a plurality of bendable tabs and a cover screw engaging yoke extend. The adapter device is affixed in an electrical access hole in the body of the electrical light fixture and enables the light fixture to be temporarily suspended from the partially unscrewed cover screw on the electrical box. The temporarily suspended light fixture may be readily aligned with adjacent walls, etc., rotated to enable installation of permanent support anchors, and repositioned to permanently secure it to the installed support anchors.

6 Claims, 3 Drawing Sheets

ADAPTER DEVICE FOR MOUNTING A CEILING ELECTRICAL LIGHT FIXTURE

BACKGROUND OF THE INVENTION

This invention relates generally to the overhead installation of a cumbersome electrical light fixture, such as a fluorescent light fixture, and in particular to a method and apparatus for enabling one person to install a cumbersome electrical light fixture to a ceiling-mounted electrical box.

Installation of a relatively large electrical light fixture, to a ceiling generally requires two persons or the provision of separately installed adapter devices on the ceiling. The prior art includes a number of patents describing devices for aiding in the installation of such cumbersome light fixtures. Among these patents are the following.

U.S. Pat. No. 2,433,819, issued Dec. 30, 1947 to K. Scribner in which a separate plate, having a plurality of downwardly projecting slotted tabs for embracing studs in the sides of a lighting fixture, is secured to the ceiling. The adapter plate requires separate installation and the lighting fixture must have non-standard mounting studs, both of which detract from the benefits of the arrangement.

U.S. Pat. No. 4,368,506, issued Jan 11, 1983 to W. Rapp similarly discloses a special mounting base and removable mating bracket. The mounting base is separately secured over an electrical outlet box in the ceiling and the mating bracket attached to the lighting fixture. The arrangement enables the lighting fixture to be temporarily suspended from the mounting base while enabling electrical and mechanical installation by one person. The arrangement involves the installation of a separate mounting base and a mating removable bracket, which is relatively costly and time consuming.

SUMMARY OF THE INVENTION

The present invention comprises a very simple, economical method and apparatus for simplified installation of cumbersome electrical lighting fixtures. It includes an adapter that is secured to the light fixture, without fasteners, which enables the light fixture to be temporarily suspended from the cover screw of an electrical box in the ceiling to enable electrical and mechanical installation of the light fixture by one person. While a fluorescent light fixture is described, it will be appreciated that the invention is directed to any cumbersome electrical light fixture.

OBJECTS OF THE INVENTION

A principal object of the invention is to provide a novel method and apparatus for enabling ceiling installation of a cumbersome light fixture by one person.

Another object of the invention is to provide an economical method and apparatus for enabling one person installation of a ceiling mounted electrical light fixture.

A further object of the invention is to provide an adapter for a standard fluorescent fixture to simplify its installation.

A feature of the invention is the provision of a simple, readily installed adapter for enabling ceiling installation of a cumbersome light fixture by one person.

BRIEF DESCRIPTION OF THE DRAWINGS

These and other objects and advantages of the invention will be apparent upon reading the following description in conjunction with the drawings in which.

DETAILED DESCRIPTION OF THE INVENTION

Figure 1:
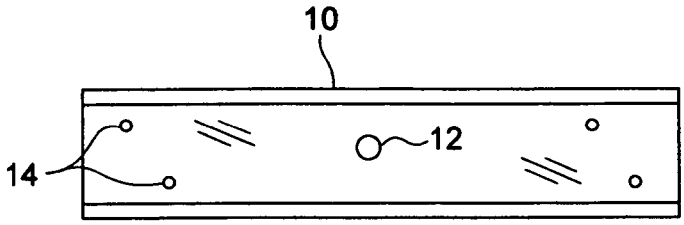
FIG. 1 is a greatly reduced, not-to-scale, plan view of the sheet metal body of a prior art standard eight-foot fluorescent light fixture.
Figure 2:
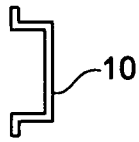
FIG. 2 is a right side view of the top cover of the body of FIG. 1.

FIGS. 1 and 2 are not-to-scale views of a body 10 of a conventional fluorescent light fixture. The body 10 includes a centrally located electrical access hole 12 for permitting electrical connections to be made between the elements of the fluorescent fixture and the installation's electrical wiring (neither of which is shown). A plurality of mounting holes 14 are provided in body 10 for securing the fluorescent light fixture to a ceiling. It will be appreciated that elements of the fluorescent light fixture, such as sockets, wiring, ballasts and bulbs are not shown. These elements are well known and form no part of the present invention. All of the elements, with the exception of the bulbs, are generally secured to the body 10 at the time of installation of the fluorescent fixture. It will therefore be appreciated that the weight of the light fixture is considerable as well as cumbersome since it is up to eight feet long and fifteen or more inches wide. Consequently installation generally requires two people or the use of one of the prior art techniques and apparatus.

Figure 3:
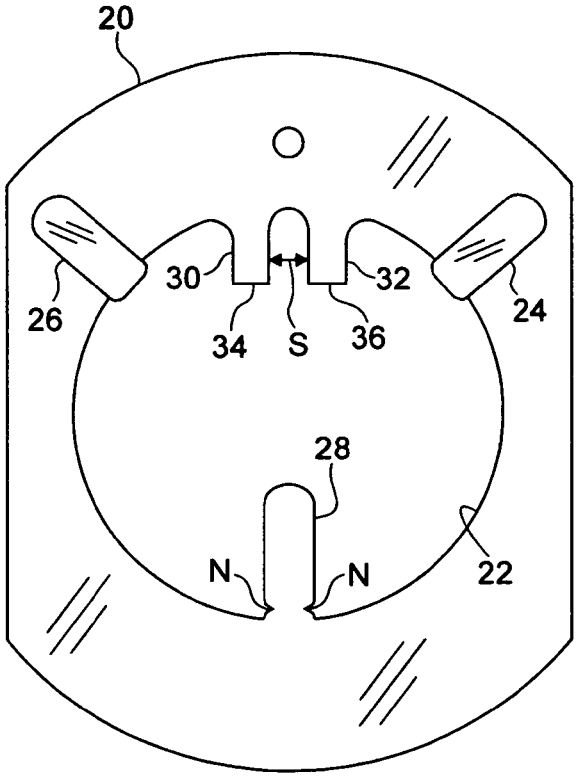
FIG. 3 is a full-scale plan view of an adapter plate constructed in accordance with the invention.
Figure 4:
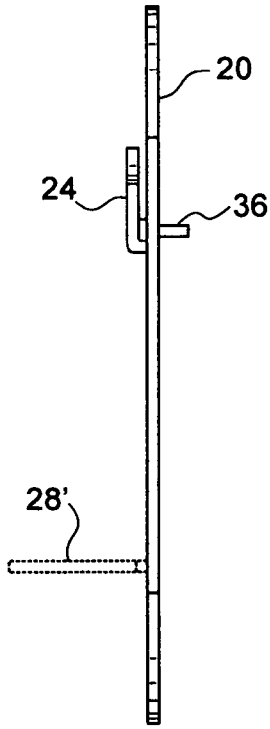
FIG. 4 is right side view of the adapter plate of FIG. 3 with bendable tab 28 displaced at right angles for installation in the electrical access hole in the electrical fixture.

In accordance with the invention, an adapter device is secured to the body 10, specifically the adapter device is secured in the centrally located electrical access hole 12 in body 10 to serve as a temporary support for the fluorescent light fixture to enable one person to install the light fixture to a ceiling. A preferred form of an adapter device is shown in FIG. 3. Initially the device comprises a stamped metal plate 20 defining a hole 22 having three bendable mounting tabs 24, 26 and 28 extending into the hole. The diameter of hole 22 is approximately the same as that of electrical access hole 12 in body 10 so that the mounting tabs may be bent back and flattened over body 10 to secure adapter device 20 in electrical access hole 12. To simplify installation of the adapter device 20 in the field, two of the tabs (24 and 26) are initially pre-bent to overlie the body of adapter device 20. A yoke, formed of closely spaced legs 30 and 32, having upturned ends 34 and 36, respectively, also extends into hole 22 for providing a screw head captivation arrangement, as will be described. The upturned end 36 of tab 32 is best seen in the side view of FIG. 4, and as indicated by the dashed lines, tab 28' has been bent back at a right angle prior to installation of adapter device 20 in electrical access hole 12 of body 10. To facilitate proper bending of tabs 24-28, a pair of small notches "N" is formed at the base of each of the tabs.

Tabs 24-28 are inserted in electrical access hole 12 and flattened over to securely sandwich body 10 as shown. To facilitate operation of the screw head captivation arrangement, the adapter device 20 is installed on the body 10 so that upturned ends 34, 36 of legs 30, 32, respectively, face away (down) from the ceiling when the fluorescent light fixture is installed. These legs 30 and 32 of the yoke are separated by a distance "S".

Figure 5:
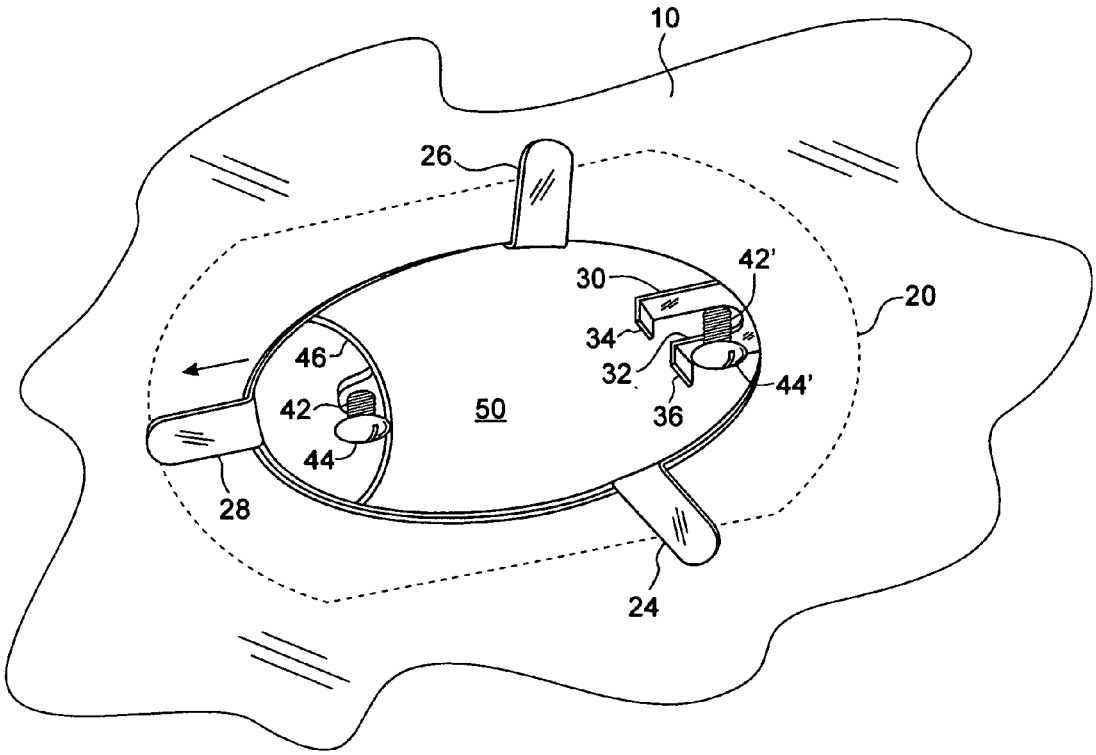
FIG. 5 is a partial perspective view showing the installed adapter plate and light fixture engaging the cover screw of an electrical ceiling box.
Figure 6:
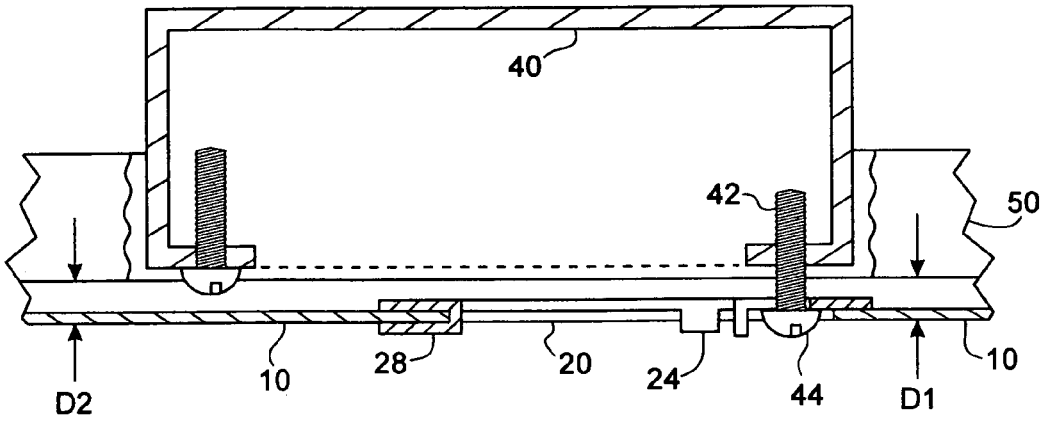
FIG. 6 is a sectional view through the ceiling box, adapter plate and light fixture body.

FIGS. 5 and 6 illustrate the method and apparatus of the invention. In FIG. 5, the fluorescent fixture, with adapter device 20 installed in electrical access hole 12 of body 10, (only a portion of which is illustrated) is presented to an electrical box 40, that is securely mounted in ceiling 50, with the cover screw 42 of electrical box 40 having been unscrewed to a position extending well below the surface of ceiling 50. The fluorescent fixture is held substantially parallel to ceiling 50 and moved such that adapter device 20 is aligned with electrical box 40 with the screw head captivation arrangement of legs 30 and 32 straddling cover screw 42. It will be appreciated that the distance "S" between legs 30 and 32 of the yoke is selected to be slightly greater than the diameter of the cover screw 42, but less than the diameter of screw head 44. The fluorescent fixture is positioned over electrical box 40 with cover screw 42 engaging adapter device 20, as illustrated by the position of the cover screw 42' shown in dotted lines. In this position, the installer may lower the fluorescent fixture until legs 30 and 32 rest on screw head 44 whereby the weight of the fluorescent fixture is transferred to the electrical box. In the lowered position, the upturned ends 34,36 of legs 30,32 prevent disengagement of legs 30,32 from screw head 44, thus captivating the fluorescent fixture. It will be noted that in this position one end of body 10 engages ceiling 50 (engagement point not visible in the partial view) with body 10 assuming a slight angular displacement from ceiling 50. This orientation is illustrated in FIG. 7 in which the distance "D1" is seen to be slightly smaller than the distance "D2".

With the fluorescent fixture being temporarily supported (via the yoke legs 30 and 32 of the adapter device 20 and the cover screw 42 of electrical box 40) from the ceiling, the installer may align and permanently secure the fixture. For example, in this position, the fluorescent fixture may be rotated about the cover screw 42 to its desired orientation with respect to the room walls, etc., and its position appropriately marked on the ceiling through one or more of the mounting holes 14 in body 10 (see FIG. 1). The fixture may then be rotated out of the way, and while still being supported by the electrical box 40, suitable anchors can be installed at the now-revealed marked locations on ceiling 50. The fixture is then returned to the desired position so that fasteners may be attached to the anchors for permanently securing the fixture to the ceiling. It will be appreciated that the cover screw 42 my also be tightened to further secure the fixture to the ceiling. Electrical connections may then be made and the fluorescent bulbs installed.

Figure 7:
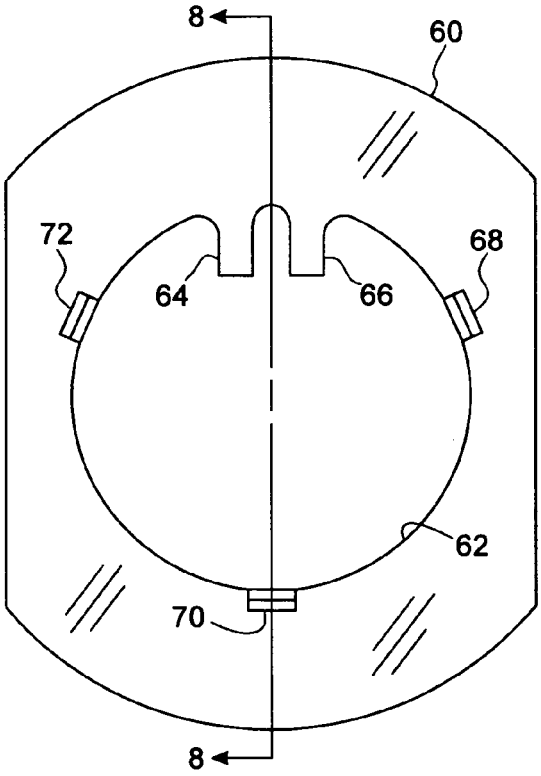
FIG. 7 illustrates a molded plastic adapter plate constructed in accordance with the invention.
Figure 8:
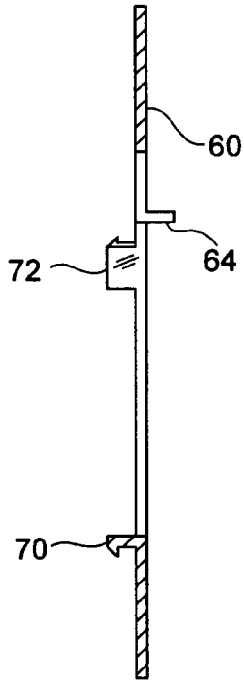
FIG. 8 is a cross section taken along line 8-8—of FIG. 7.

FIGS. 7 and 8 illustrate a different form of adapter device 60, one that is molded of plastic. The basic construction is the same as that of adapter device 20 with L-shaped legs 64 and 66 corresponding to legs 30 and 32 forming the screw head captivating arrangement and locking tangs 68, 70 and 72 replacing bendable tabs 24, 26 and 28. Adapter device 60 is simply snapped into electrical access hole 12 of body 10 and locked thereto by locking tangs 68-72. Because the locking tangs of adapter 60 do not grasp body 10 as securely as the bendable tabs of adapter 20, adapter plate 60 is preferably installed in body 10 with its large surface positioned between body 11 and ceiling 50. In this manner the locking tangs remain essentially unloaded when adapter plate 60 is supporting the light fixture. In all other respects the adapter devices are the same in function.

What has been described is a novel method and apparatus for enabling installation of cumbersome electrical fixtures by one person. It is recognized that numerous changes to the described embodiment of the invention will be apparent to those skilled in the art without departing from its true spirit and scope. The invention is to be limited only as defined in the claims.

The invention claimed is:

1. A method of enabling one person to install a cumbersome lighting fixture, such as a fluorescent light, to a ceiling that is provided with an electrical junction box having a cover screw comprising:

providing a screw head captivation adapter for the electrical access hole in the body of the lighting fixture;

the screw head captivation adapter including a metallic mounting plate having a plurality of bendable tabs for securing it in the electrical access hole of the lighting fixture body and a yoke having a pair of legs with upturned ends for engaging the head of the cover screw;

adjusting the head of the cover screw on the junction box to a position displaced below the surface of the ceiling;

engaging the screw head captivation adapter with the head of the cover screw for temporarily supporting the lighting fixture from the electrical junction box;

rotating the temporarily supported lighting fixture to a desired position on the ceiling;

marking the location of a mounting hole in the lighting fixture on the ceiling;

rotating the lighting fixture about the screw head to reveal the marked location;

installing a mounting anchor in the ceiling at the marked location;

returning the lighting fixture to the desired position; and securing the lighting fixture to the mounting anchor with a fastener.

2. An adapter device for enabling one person installation of a cumbersome electrical light fixture, having an electrical access hole in its body, to a ceiling-mounted-electrical box having a depending cover screw comprising: a plate having a generally circular opening with a plurality of circumferentially arranged mounting means for securing said plate in said electrical access hole of said body of said light fixture; and a screw head captivation yoke integral with said plate, said yoke including legs having upturned ends for engaging the head of said cover screw, for temporarily supporting said plate and said light fixture from said cover screw to enable horizontal rotational positioning of said light fixture; and the distance between said legs being greater than the diameter of said cover screw and less than the diameter of the head of said cover screw; wherein said plate is metallic and said mounting means comprise bendable tabs.

3. The adapter of claim 2, wherein said bendable tabs are notched to facilitate bending and flattening over said body.

4. The adapter of claim 2, wherein said plate is plastic and wherein said mounting means comprise deflectable locking tangs for securing it in said electrical access hole.

5. In combination:

an electrical light fixture with a body having an electrical access hole for enabling inspection of or the making of electrical connections to a ceiling mounted electrical box having a depending cover screw;

a metallic adapter plate having a plurality of bendable tabs for securing said adapter plate in the electrical access hole of said body and an integral screw head captivation yoke for engaging the head of said cover screw;

said screw head captivation yoke comprising a pair of legs having raised ends, the distance between said legs being greater than the diameter of said cover screw and less than the diameter of the head of said cover screw whereby said raised ends serve to captivate said yoke on said cover screw, thereby facilitating installation of said light fixture by one person by temporarily supporting said light fixture from said electrical box while permanent supports are installed.

6. The combination of claim 5, wherein said bendable tabs are notched to facilitate manual bending and flattening over said body.

* * * * *